US007258254B2

(12) United States Patent
Johanson

(10) Patent No.: US 7,258,254 B2
(45) Date of Patent: Aug. 21, 2007

(54) DISPENSING END CAP

(75) Inventor: James E Johanson, Old Chatham, NY (US)

(73) Assignee: Sonoco Development, Inc., Hartsville, SC (US)

( * ) Notice: Subject to any disclaimer, the term of this patent is extended or adjusted under 35 U.S.C. 154(b) by 279 days.

(21) Appl. No.: 11/088,309

(22) Filed: Mar. 24, 2005

(65) Prior Publication Data

US 2006/0213933 A1 Sep. 28, 2006

(51) Int. Cl.
*B65D 5/72* (2006.01)

(52) U.S. Cl. ..... 222/494; 220/203.15

(58) Field of Classification Search ..... 222/494, 222/1, 402.1, 402.13, 406, 92, 95, 100, 105, 222/565, 478, 481.5, 482, 485, 491, 511, 222/517, 492, 499, 512, 513, 519, 522; 220/203.15, 220/203.16, 203.17, 203.19, 203.11; 215/310, 215/311; 417/393, 394, 565, 389, 454, 455
See application file for complete search history.

(56) References Cited

U.S. PATENT DOCUMENTS

| | | | | |
|---|---|---|---|---|
| 1,650,966 | A | 11/1927 | Smith | |
| 1,658,233 | A | 2/1928 | Falk | |
| 2,898,007 | A | 8/1959 | Gassaway | |
| 4,005,226 | A | 1/1977 | Dykes et al. | 426/281 |
| 4,363,166 | A | 12/1982 | Hiller | 483/40 |
| 4,561,571 | A | 12/1985 | Chen | 222/207 |
| 4,572,413 | A | 2/1986 | Vogt | 222/528 |
| 4,589,577 | A | 5/1986 | Welsh et al. | 222/518 |
| 4,760,938 | A | 8/1988 | Wenger | 222/498 |
| 4,784,299 | A | 11/1988 | Stenger | 222/397 |
| 4,871,090 | A | 10/1989 | Hoffmann | 222/81 |
| 4,871,093 | A | 10/1989 | Burshtain et al. | 222/213 |
| 4,890,773 | A * | 1/1990 | Corsette | 222/380 |
| 4,949,882 | A | 8/1990 | Take | 222/528 |
| 5,025,955 | A | 6/1991 | Stenger | 222/82 |
| 5,035,320 | A | 7/1991 | Plone | 206/219 |
| 5,271,533 | A * | 12/1993 | Joulia | 222/402.13 |
| 5,273,190 | A | 12/1993 | Lund | 222/83 |
| 5,350,083 | A | 9/1994 | Du | 222/134 |
| 5,364,244 | A | 11/1994 | Taylor-McCune et al. | 417/536 |
| 5,373,964 | A | 12/1994 | Moore | 222/1 |
| 5,425,479 | A | 6/1995 | Credle, Jr. | 222/548 |
| 5,454,486 | A | 10/1995 | Mack et al. | 222/95 |

(Continued)

FOREIGN PATENT DOCUMENTS

| | | | | |
|---|---|---|---|---|
| GB | 2161222 | * | 1/1986 | 222/402.13 |

*Primary Examiner*—Lien M. Ngo
(74) *Attorney, Agent, or Firm*—DLA Piper US LLP

(57) ABSTRACT

An end cap is attached to a container body to form a liquid media package for dispensing liquid media. The end cap includes an aperture in fluid communication with the liquid media in the package. The end cap also includes at least one radial arm extending outwardly from the aperture, each radial arm being in fluid communication with the aperture. Each radial arm includes at least one flexible wiper in a closed position, and one orifice corresponding to each of the at least one flexible wipers. When pressure is exerted on the liquid media, the liquid media travels through the aperture and then through the radial arms. The pressure of the liquid media displaces the flexible wiper so as to enable flow of the liquid media through an orifice in the bottom of the end cap. The flexible wiper returns to the closed position when exertion of pressure ceases.

14 Claims, 4 Drawing Sheets

U.S. PATENT DOCUMENTS 5,454,488 A * 10/1995 Geier ..... 222/95
5,487,490 A 1/1996 Estes ..... 222/1
5,617,978 A * 4/1997 Geier ..... 222/402.13
5,622,484 A 4/1997 Taylor-McCune et al. .. 417/393
D392,509 S 3/1998 Martindale ..... D7/599
5,740,945 A 4/1998 Shipway ..... 222/1
D406,240 S 3/1999 Guillemot ..... D9/448
5,947,315 A 9/1999 Valyi et al. ..... 220/258.1
6,050,451 A 4/2000 Hess, III et al. ..... 222/92
6,065,649 A 5/2000 Scoggins ..... 222/181.2
6,305,413 B1 10/2001 Fischer et al. ..... 137/493.8
6,378,742 B1 4/2002 Rohr et al. ..... 222/494
6,581,808 B2 6/2003 De Laforcade ..... 222/483
6,623,257 B2 9/2003 Taniguchi ..... 417/478

* cited by examiner

DISPENSING END CAP

TECHNICAL FIELD

The invention is in the field of devices for dispensing liquids, slurries and viscous fluids.

BACKGROUND OF THE INVENTION

It is desirable when dispensing liquids, including viscous fluids and slurries, to limit the dispensing to a pre-determined volume or amount without leakage or seepage of liquid following completion of dispensing. Effective control over the dispensing of liquids avoids waste and reduces the amount of residue remaining on the dispenser following completion of dispensing. Such control also avoids imparting unintended characteristics to the material, composition or process as a result of receiving greater than intended amounts of liquid from the dispensing device.

It is also often desirable when dispensing liquids, slurries and viscous materials to obtain a relatively uniform or pre-determined distribution of the dispensed liquid. Condiments such as ketchup, mustard and mayonnaise, for example, when dispensed commercially on prepared food items, are preferably dispensed relatively uniformly over the surface of the prepared food item.

Previous liquid dispensers often consisted of either deformable or rigid containers fitted with a nozzle or opening. Deformable containers typically dispense when pressure is applied to the containers' walls. Rigid dispensers typically dispense when pressure is applied directly to the contents of the package or to a non-rigid portion of the container. A plunger or other pressure generating device acting on the contents of the rigid package through an aperture in the package, for example, can actuate dispensing.

Both deformable and rigid packages containing liquid to be dispensed are typically fitted with end caps, nozzles or other openings to allow passage of the dispensed liquid in response to pressure applied to the package or its contents. Often these end caps, nozzles or openings fail to effectively cut off passage of the dispensed liquid when the applied pressure is removed, allowing unintended leakage or seepage of the liquid dispensed.

As a result of such leaking or seepage, a portion of the liquid can form a residue on the nozzle or other opening in the package.

With the passage of time, this residue can accumulate or cake on the nozzle or other opening. This, in turn, can result in clogging, impeding later efforts to dispense through the nozzle or opening. While such residue can be removed manually, manual removal may occur irregularly and be ineffective. Commercial users of dispensers, such as restaurants, also face added costs if employees must devote time to removing residue from dispensers. In addition, even with removal of this residue, wastage caused by excess dispensing will remain.

SUMMARY OF THE INVENTION

An end cap is provided for use with a container body for retaining a quantity of a liquid media. The end cap includes an aperture in fluid communication with the liquid media in the container body. The end cap also includes at least one radial arm extending outwardly from the aperture. The radial arm defines an internal conduit in fluid communication with the aperture. The radial arm includes at least one flexible wiper in a closed position, and one orifice corresponding to each of the at least one flexible wipers. When pressure is exerted on the liquid media, the liquid media travels through the internal conduit causing the flexible wiper to displace to an open position enabling flow of the liquid media through the orifice. The flexible wiper returns to the closed position when exertion of pressure ceases.

BRIEF DESCRIPTION OF THE DRAWINGS

For the purpose of illustrating the invention, there is shown in the drawings various forms that are presently preferred, it being understood, however, that this invention is not limited to the precise arrangements and constructions particularly shown.

While the invention will be described in connection with one or more preferred embodiments, it will be understood that the description is not intended to limit the invention to any particular embodiment. On the contrary, it is intended to cover all alternatives, modifications, and equivalents as may be included within the spirit and scope of the invention as defined by the appended claims.

DETAILED DESCRIPTION OF THE DRAWINGS

Figure 1:
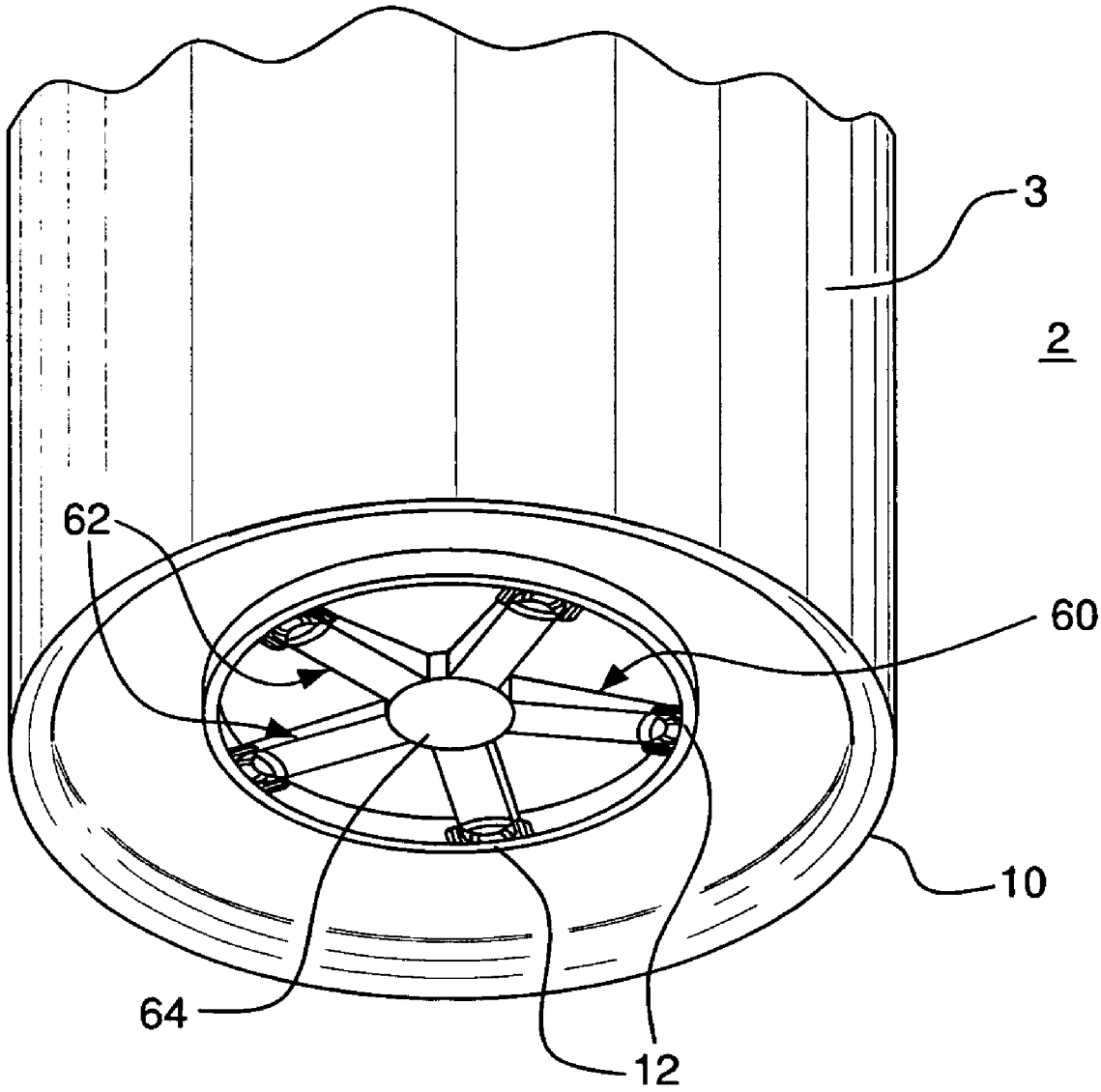
FIG. 1 is a perspective view illustrating an embodiment of the end cap of the present invention, fitted to a liquid media container.

Referring now to the drawings wherein like reference numerals identify like elements, components, subassemblies, FIG. 1 shows an end cap 10 attached to a container body 3 to form a liquid media package 2. As used herein, "attached to" means "secured to," "coupled with," "engaged with," "integral with," or some other similar attachment means. For example, the end cap 10 can be integral with the container body 3, i.e., the container body 3 and the end cap 10 are in fact one piece. Alternatively, the attachment of the end cap 10 with the container body 3 can be accomplished by means of an adhesive, heat seal, or by some other similar means. Certain other terminology is used herein for convenience and is not intended to be taken as a limitation on the invention. Particularly, words such as "upper," "lower," "left," "right," "horizontal," "vertical," "upward," and "downward" merely describe the configuration shown in the figures.

The package 2 can be a rigid container, a squeezable pouch, or some other container capable of housing a liquid media. As used herein, "liquid media" means liquids, slurries and fluids. For example, the liquid media can be viscous fluid or slurry, such as those employed as condiments in the food service industry, e.g., ketchup, mayonnaise, mustard. While the preferred use of the package 2 is for storing and dispensing a food product, it will be appreciated that the description herein is applicable to any liquid media container which dispenses other liquid media, e.g., caulking, adhesives, toothpaste.

As illustrated, the end cap 10 comprises a plurality of radial arms 62 that extend from a substantially circular central aperture 64 and that contact a first wall 68 in the end cap 10. The first wall 68 can comprise a ring structure that can be attached to end cap 10. A flexible wiper 66 can be located in each radial arm 62 at an outboard end of the radial arm 62, i.e., where the radial arm 62 contacts the first wall 68. In a closed position, the flexible wiper 66 forms a seal with first wall 68 and a flexible wiper mount 70 such that the liquid media is retained in the liquid media package. When the flexible wiper 66 is an open position it is displaced from the first wall 68 and the mount 70, allowing liquid media to flow through orifices 12 in response to pressure in the liquid media.

Figure 4:
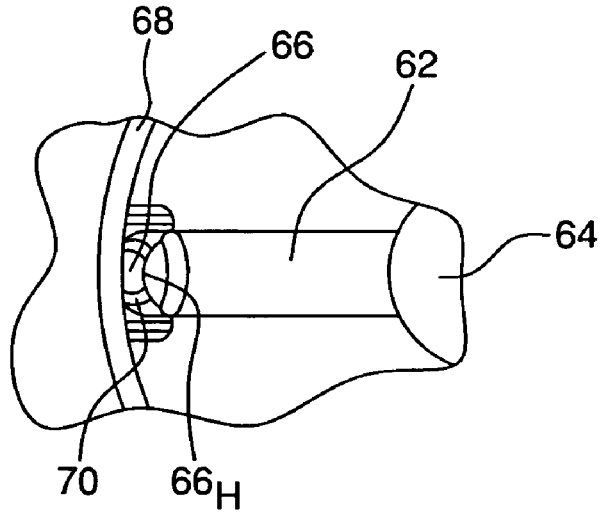
FIG. 4 is an enlarged, bottom plan view of an embodiment of the present invention with a circular flexible wiper seated in a circular mount at the end of a radial arm.
Figure 5:
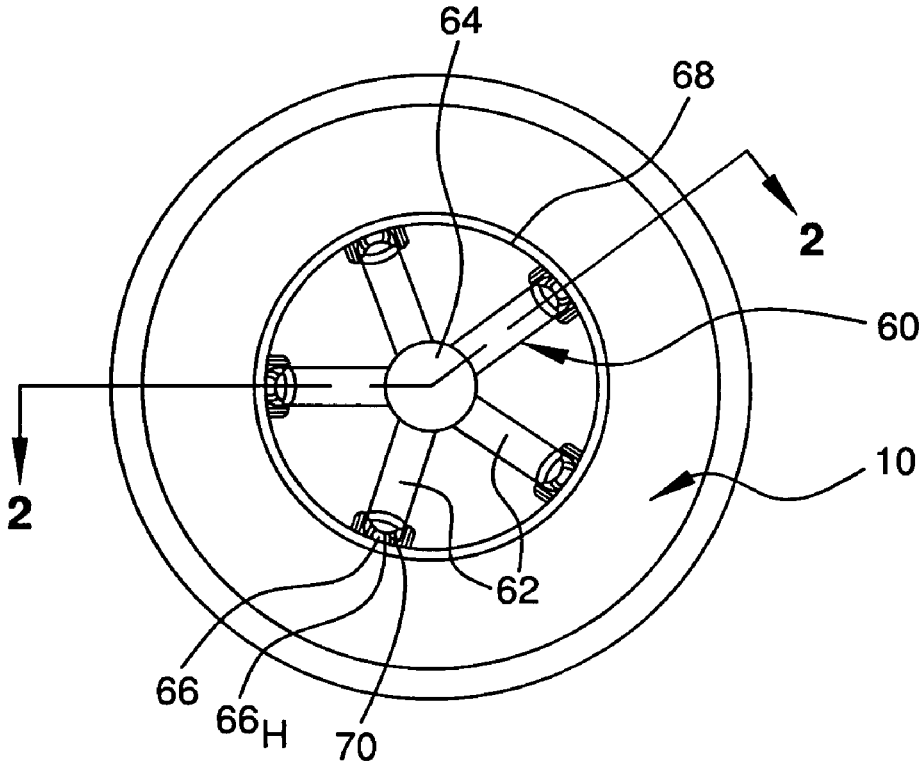
FIG. 5 is bottom plan view of the end cap of the present invention.

Although the flexible wipers 66 are illustrated in FIGS. 4 and 5 as being located at the outboard end of the radial arms 62, the flexible wipers 66 can be located at various and multiple locations on the radial arms 62. For example, a plurality of flexible wipers 66 can be disposed along a radial arm 62, wherein none of the flexible wipers 66 contact the first wall 68. The flexible wipers 66 and associated mounts 70 can also take a variety of shapes in addition to the substantially circular shape illustrated.

The flexible wipers 66 can be oriented in a circular pattern to deliver and distribute liquid media over a predetermined circular area. A circular pattern can be desirable, for instance, to dispense a condiment in a circular pattern on a food product having a substantially circular shape such as a patty of ground beef, chicken or fish (not shown). Alternatively, the orientation can be non-circular. The orientation can reflect or compliment the shape of the item upon which the liquid media is to be dispensed or deposited, e.g., linear, polygonal.

Figure 2:
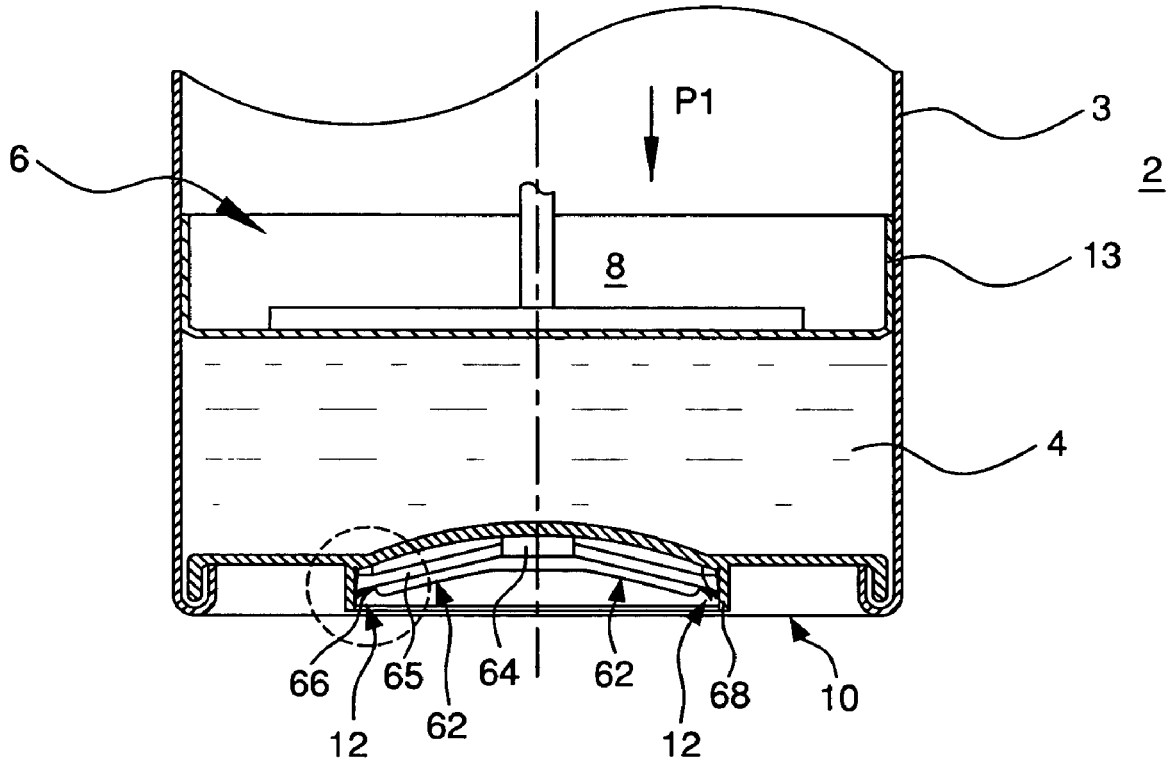
FIG. 2 is cross-sectional view of the end cap of FIG. 1 taken along line 2-2 of FIG. 5.

The package 2 may include a pressure generating means 6 to exert pressure P1 on the liquid media. As shown in FIG. 2, pressure generating means 6 can be a plunger assembly 8. The plunger assembly 8 can include a piston 13 that is displaced axially within a bore of the liquid media package 2 as a response to motion imparted to the plunger assembly 8 by any of a variety of mechanisms known to those skilled in the art. For example, if a tubular liquid media package 2 is supported within a fixture (not shown), a conventional lever arm may suffice to displace the piston 13. Alternatively, or additionally, a conventional means for translating rotational into axial motion may be employed.

While the preferred pressure generating means 6 is a plunger assembly 8, it will be appreciated that other means of exerting pressure can be used. For example, liquid media package 2 can comprise a squeezable pouch such as a traditional toothpaste dispenser or other similar container. With such an embodiment, the requisite pressure P1 is exerted by squeezing the exterior of the container.

Figure 3A:
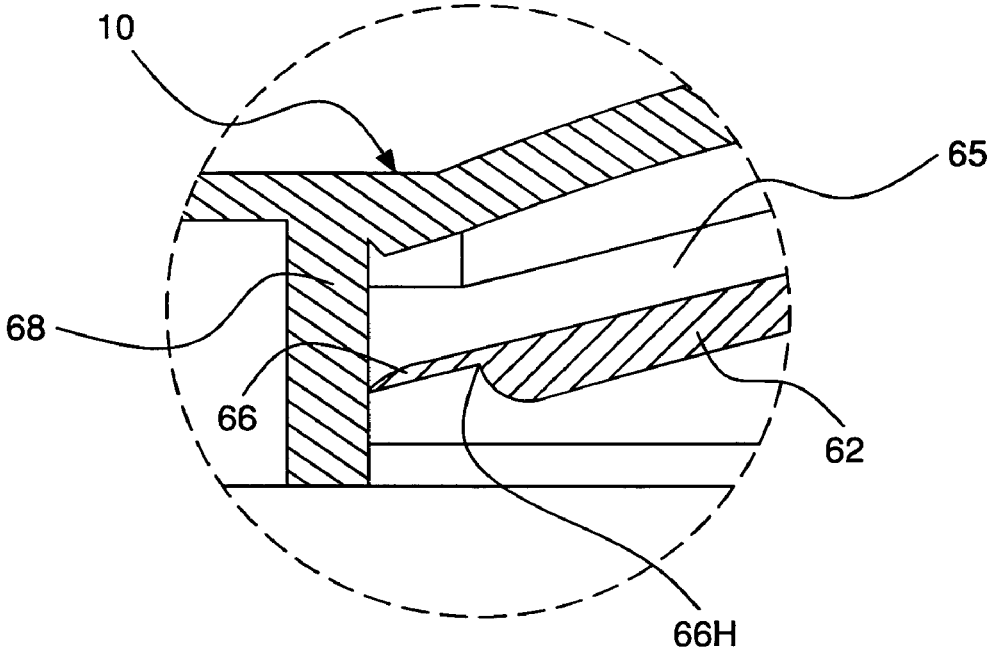
FIG. 3A is an enlarged sectional view of FIG. 2, illustrating a flexible wiper of the present invention in a closed position.
Figure 3B:
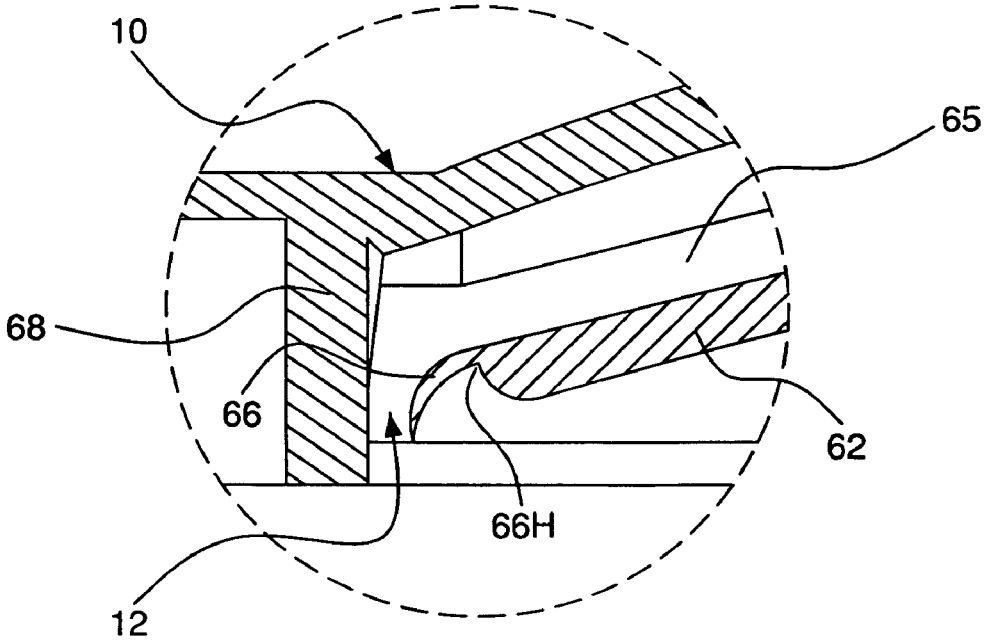
FIG. 3B is an enlarged sectional view of FIG. 2, illustrating the flexible wiper of the present invention in an open position.

In operation, aperture 64 is in fluid communication with the liquid media in container body 3. Aperture 64 is also in fluid communication with each of the radial arms 62 via internal conduits 65 that extend from the aperture to the flexible wipers 66 in each of the radial arms 62. When pressure PI is developed by the pressure generating means 6, pressurized liquid media 4 is caused to advance through the internal conduits 65 in each of the radial arms 62. When the pressurized liquid media 4 exceeds a threshold pressure greater than that of the hydrostatic pressure of the liquid media alone, the flexible wiper 66 rotates about a hinge $\mathbf{66}_H$ forcing the flexible wiper 66 from a closed position as shown in FIG. 3A to an open position as shown in FIG. 3B, thus allowing the release of the liquid media through the corresponding orifice 12 in the end cap 10. When pressure P1 is reduced, the flexible wiper 66 returns to the closed position, sealing the orifice 12 through contact of the flexible wiper 66 with its respective mount 70 and with the first wall 68. Consequently, the flexible wiper 66 acts as a valve that is entirely responsive, i.e., opens and shuts, in response to the pressure P1 developed internally of the package.

Displacement of the flexible wiper 66 about hinge $\mathbf{66}_H$ can be accomplished by means of spring loading the hinge $\mathbf{66}_H$ or by tensioning the hinge $\mathbf{66}_H$ or the flexible wiper 66 by other means known to those skilled in the art. Alternatively, displacement can be accomplished by proper selection of materials for the flexible wiper 66 and the hinge $\mathbf{66}_H$. Preferably, flexible wiper 66 and hinge $\mathbf{66}_H$ comprise a material with a low modulus of elasticity (i.e., high flexibility). With the flexible material, flexible wiper 66 can rotate about hinge $\mathbf{66}_H$ so as to allow displacement of the flexible wiper 66 from the closed position to the open position. The modulus of elasticity cannot, however, be too low, otherwise flexible wiper 66 would permanently deform preventing a snap-back hinge action about hinge $\mathbf{66}_H$, and thus not providing a good seal when pressure on the liquid media is reduced.

As shown in FIG. 4, each flexible wiper 66 and corresponding mount 70 can be substantially circular and can be located at the end of each radial arm 62 where the radial arm 62 contacts the first wall 68 of the end cap 10.

As shown in FIG. 5, the preferred embodiment of the present invention comprises an end cap 10 with five radial arms 62 extending from a central aperture 64 in a star-shaped configuration. At the outboard end of each of the radial arms 62 is a flexible wiper 66 seated in its mount 70. In this embodiment, the flexible wiper 66 is also in fluid sealable contact with the first wall 68. It will appreciated that the illustrated star-shaped configuration is just one of many possible configurations. For example, the radial arms 62 can number more or fewer than five. The radial arms 62 can be in a configuration other than star-shaped, such as square, polygonal, or non-standard configuration. The radial arms 62 can be on essentially the same plane as the end cap 10, can be oblique with respect to the plane of the end cap 10, or the radial arms can be a combination where at least one radial arm 62 is on the same plane as the end cap 10 and at least one radial arm 62 is oblique With-respect to the plane of the end cap 10.

While the liquid media package 2 is shown as cylindrical, other cross-sectional-shapes, including square, polygonal or elliptical are available provided the piston 13 or plunger 8 assembly, if applicable for generating the requisite pressure, has a complementary shape.

It will be appreciated by those skilled in the art, that the present invention can be practiced in various alternate forms and configurations and still fall within the scope of the appended claims. The previously detailed description of the disclosed embodiments are presented for purposes of clarity of understanding only, and no unnecessary limitations should be implied therefrom.

What is claimed is:

1. An end cap for use with a container body retaining a quantity of a liquid media, the end cap comprising:

an aperture in fluid communication with the liquid media in the container body; and a plurality of radial arms extending outwardly from the aperture, the radial arms each defining an internal conduit in fluid communication with the aperture, the radial arms including at least one flexible wiper normally maintained in a closed position and an orifice corresponding to the flexible wiper;

wherein where pressure is exerted on the liquid media, the liquid media travels through the internal conduits causing the flexible wipers to displace to an open position enabling flow of the liquid media through the orifices, and the flexible wipers returning to the closed position when exertion of pressure ceases; and wherein at least one radial arm is disposed obliquely with respect to the plane of the end cap.

2. The end cap of claim 1 wherein the end cap is integrally formed with the container body to form a package.

3. The end cap of claim 1 further comprising a pressure generating means for pressurizing the liquid media to cause the flexible wiper to displace from the closed position to the open position.

4. The end cap of claim 3 wherein the pressure generating means includes a plunger assembly including a piston.

5. The end cap of claim 1 wherein a ring structure is attached to the end cap.

6. The end cap of claim 5 wherein an outboard end of at least one of the radial arms contacts the ring structure.

7. The end cap of claim 6 wherein the flexible wiper is located at the outboard end of the at least one radial arm that contacts the ring structure.

8. The end cap of claim 1 wherein a plurality of flexible wipers are disposed at the end of at least one radial arm.

9. The end cap of claim 1 wherein the aperture is substantially circular.

10. The end cap of claim 1 wherein the radial arms are each disposed along essentially the same plane.

11. An end cap for use with a container body retaining a quantity of a liquid media, the end cap comprising:

an aperture in fluid communication with the liquid media in the container body;

a plurality of radial arms extending outwardly from the aperture, the radial arms defining an internal conduit in fluid communication with the aperture, the radial arms including at least one flexible wiper normally maintained in a closed position and an orifice corresponding to the flexible wiper, wherein at least one radial arm is disposed in essentially the same plane as that of the end cap and at least one radial arm is disposed obliquely to the plane of the end cap; and wherein where pressure is exerted on the liquid media, the liquid media travels through the internal conduits causing the flexible wipers to displace to an open position enabling flow of the liquid media through the orifices, and the flexible wipers return to the closed position when the pressure is withdrawn.

12. The end cap of claim 1 wherein the flexible wipers are circular and are seated in a circular mount.

13. A package for dispensing liquid media comprising:

a container body retaining a quantity of a liquid media;

an end cap attached to the container body, the end cap including a first wall, a centrally located aperture, a plurality of radial arms extending outwardly from the aperture and contacting the first wall, the radial arms defining an internal conduit that is in fluid communication with the aperture, and the radial arms including at least one flexible wiper for selectively releasing the liquid media from the radial arms, the flexible wiper responding to pressure developed internally within the package; and at least one orifice for directing the liquid media released from the internal conduits by the flexible wipers externally of the package; and wherein the radial arms are disposed obliquely with respect to the plane of the end cap.

14. A container for retaining a quantity of a liquid media, the container having an end cap thereon and means for exerting pressure on the liquid media within the container, comprising:

an aperture in fluid communication with the liquid media in the container body; and a plurality of radial arms extending outwardly from the aperture, the radial arms defining an internal conduit in fluid communication with the aperture, the radial arms including at least one flexible wiper located at an outboard end thereof, the flexible wipers normally maintained in a closed position, closing an orifice at the end of the conduit; and wherein where pressure is exerted on the liquid media, the liquid media is forced into the aperture and through the internal conduits, causing the flexible wipers to displace to an open position and enabling flow of the liquid media through the orifices, the flexible wipers returning to the closed position when the exertion of pressure is withdrawn.

* * * * *